US005427885A

United States Patent [19]

Ota et al.

[11] Patent Number: 5,427,885

[45] Date of Patent: Jun. 27, 1995

[54] PROCESS FOR PRODUCING TONER THROUGH SUSPENSION POLYMERIZATION

[75] Inventors: Nobuyasu Ota; Toyoko Imai; Jun Saito; Tokudai Ogawa, all of Kawasaki, Japan

[73] Assignee: Nippon Zeon Co., Ltd., Tokyo, Japan

[21] Appl. No.: 218,915

[22] Filed: Mar. 28, 1994

[30] Foreign Application Priority Data

Mar. 26, 1993 [JP] Japan ..... 5-068703
Mar. 9, 1994 [JP] Japan ..... 6-038718

[51] Int. Cl.[6] ..... G03G 9/08
[52] U.S. Cl. ..... 430/137
[58] Field of Search ..... 430/106, 108, 109, 110, 430/137

[56] References Cited

U.S. PATENT DOCUMENTS 4,448,871 5/1984 Tamaki et al. ..... 430/109
4,507,378 3/1985 Wada et al. ..... 430/137
5,344,738 9/1994 Kmiecik-Lawrynowicz et al. ..... 430/137

FOREIGN PATENT DOCUMENTS

371811A3 6/1990 European Pat. Off. .
470479A1 2/1992 European Pat. Off. .
524016A1 1/1993 European Pat. Off. .
59-33910 3/1982 Japan .
57-41646 3/1982 Japan .
57-42052 3/1982 Japan .
58-49863 3/1982 Japan .
57-53756 3/1982 Japan .
61-22354 1/1986 Japan .
63-198075 8/1988 Japan .
1-223470 9/1989 Japan .

*Primary Examiner*—John Goodrow
*Attorney, Agent, or Firm*—Lowe, Price, LeBlanc & Becker

[57] ABSTRACT

A process for producing a toner for developing an electrostatic image, including the steps of: adding to an aqueous dispersion medium a polymerizable monomer composition comprising at least a polymerizable monomer and a colorant uniformly dissolved or dispersed in the polymerizable monomer, wherein the aqueous dispersion medium containing as a dispersion stabilizer a hardly water-soluble metal hydroxide colloid formed by a reaction of a water-soluble polyvalent metal salt with an alkali metal hydroxide in an aqueous phase; and subjecting the polymerizable monomer composition to suspension polymerization, thereby to produce particles having a volume-average particle size in the range of from 2 to 20 μm and a particle size distribution (a ratio of volume-average particle size/number-average particle size) of not more than 1.6.

8 Claims, 1 Drawing Sheet

PROCESS FOR PRODUCING TONER THROUGH SUSPENSION POLYMERIZATION

BACKGROUND OF THE INVENTION

1. Field of the Invention

The present invention relates to a process for producing a toner for developing an electrostatic latent image (electrostatic charge image) which may be formed by an image forming method such as electrophotography and electrostatic recording.

2. Related Background Art

Conventionally, an electrical or electrostatic latent image formed by an image forming apparatus such as electrophotographic apparatus and electrostatic recording apparatus is subsequently developed by use of a toner to form a toner image. The toner image is transferred onto a transfer material such as paper, as desired, and then is fixed onto the transfer material by at least one of various methods such as those utilizing heat, pressure and solvent vapor to provide a copied product.

Heretofore, a toner used for such a purpose has generally been manufactured by heat-fusing and mixing predetermined components such as colorant, charge controlling agent and anti-offset agent in a thermoplastic resin to uniformly disperse them in the resin so as to provide a composition, pulverizing the composition and then classifying the resultant pulverized product.

Such a toner preparation process ( i.e., pulverization process) is capable of producing a toner having good characteristics to a certain degree, but the materials for toner usable in the pulverization process has a certain limitation. That is, the selection of such materials is rather limited. For example, the composition produced by the above-mentioned heat-fusing and mixing step is required to be a species thereof which is capable of being pulverized and classified by means of an economically usable manufacturing system. In order to satisfy this requirement, the composition produced by the heat-fusing and mixing step must be formed as a sufficiently fragile product. For this reason, when the composition is actually intended to be pulverized, the resultant particles are liable to have a broad distribution in their particle sizes. Particularly, when a toner capable of providing a copied product with good resolution and good gradation characteristic is intended to be obtained, fine particles (e.g., those having a particle size of not more than 5 μm) and coarse particles (e.g., those having a particle size of not less than 20 μm) must be removed by classification. In such a case, the resultant yield is greatly decreased.

Further, in this pulverization process, it is difficult to uniformly disperse solid fine particles such as colorant, charge controlling agent and anti-offset agent in the above-mentioned thermoplastic resin. Therefore, sufficient attention must be paid to the degree of dispersion of the solid fine particles, because an increase in fog or a decrease in image density can be caused in the development of an electrostatic latent image depending on the degree of dispersion of the solid fine particles in the thermoplastic resin.

Nonuniformity in the dispersion of the solid fine particles in the thermoplastic resin resulting from the pulverization process considerably affects the properties of the resultant toner such as fluidity and triboelectric chargeability (or charging property) and has a marked effect on the characteristics of the toner such as developing property and durability.

On the other hand, in order to overcome the above-mentioned problems encountered in the conventional pulverization process, it has been proposed to produce a toner through suspension polymerization. In this suspension polymerization process, a polymerizable monomer composition comprising a polymerizable monomer and predetermined components such as a colorant, a charge controlling agent, an anti-offset agent and a polymerization initiator uniformly dissolved or dispersed in the monomer, is charged into water (or an aqueous dispersion medium mainly comprising water) containing a dispersion stabilizer (or suspension stabilizer), is dispersed and granulated in the aqueous dispersion medium by means of a mixing device capable of providing a high shearing force, and then the resultant dispersion is subjected to polymerization to form toner particles.

In the suspension polymerization process, a dispersion stabilizer is usually contained in a dispersion medium for the purpose of stable dispersion of droplets (i.e., particles of the polymerizable monomer composition) mainly comprising a polymerizable monomer before the polymerization and for the purpose of stable dispersion of the droplets or particles of the polymerized product during the polymerization.

The dispersion stabilizer is roughly classified into two groups of a water-soluble polymer which is capable of forming a protective colloid film to provide a repulsive force on the basis of steric hindrance, and a hardly water-soluble inorganic substance capable of providing an electrostatic repulsive force so as to stabilize the dispersion.

As the former, dispersion stabilizers comprising a water-soluble polymer such as polyvinyl alcohol, methyl cellulose and gelatin have been known. It has also been proposed to produce a toner through suspension polymerization by using one of these dispersion stabilizers. However, such a suspension polymerization method is liable to produce particles including a large amount of fine particles having a small particle size, and therefore the resultant particle size distribution becomes broad. In addition, it is difficult to remove the dispersion stabilizer attached to the surfaces of the resultant toner particles. Accordingly, the thus produced toner is liable to have considerably inferior electrical characteristics (e.g., electrical resistance chargeability, etc.), and at present, there has not been obtained a toner which is acceptable to practical use.

On the other hand, as the latter hardly watersoluble inorganic substance, there have been known hardly water-soluble salts such as calcium phosphate, barium sulfate, calcium sulfate, barium carbonate, calcium carbonate and magnesium carbonate; inorganic polymers such as talc and silicic acid; metal oxides such as aluminum oxide and titanium oxide; metal hydroxides such as aluminum hydroxide and ferric hydroxide; etc. There have been also proposed processes for producing a toner through suspension polymerization by using such a dispersion stabilizer (Japanese Patent Publication (KOKOKU) No. Sho 58-49863 (i.e., No. 49863/1983); U.S. Pat. No. 4,448,871; Japanese Patent Publication No. Sho 5933910 (i.e., No. 33190/1984); U.S. Pat. 4,507,378; Japanese Laid-Open Patent Application (KOKAI) No. Sho 6122354 (i.e., No. 22354/1986); etc).

In the suspension polymerization process using the hardly water-soluble inorganic substance as described above, the particle size distribution of the resultant toner can be relatively narrow. However, in order to control the particle size within a range corresponding to an actually usable toner, there is posed a problem in the control of particle size distribution such that the amount of a dispersion stabilizer to be used for such a purpose becomes relatively large and a considerable amount of fine particles are produced on the basis of the use of a surfactant (emulsifier) as dispersing auxiliary (or dispersing assistant). Furthermore, in a case where the removal of the dispersion stabilizer and the surfactant is not sufficient by the washing of the particles with an acid or water to be conducted after the polymerization, there is posed a problem such that satisfactory electrical characteristics of the toner cannot be provided. Thus, at present, there has not been obtained a toner having excellent properties which is acceptable to practical use.

SUMMARY OF THE INVENTION

An object of the present invention is to provide a process for producing a toner through suspension polymerization (hereinafter, such a toner is sometimes referred to as "polymerization toner"), which has solved the problems as described above.

Another object of the present invention is to provide a process for producing a toner for developing an electrostatic image, which is capable of providing a toner having an excellent image quality characteristic such that it can provide a developed image with an excellent resolution and/or without fog, on the basis of an extremely sharp (or narrow) particle size distribution and good electrical characteristics of the toner.

As a result of earnest study of the present inventors, it has been found that when a hardly water-soluble metal hydroxide colloid, which has been formed on the basis of a reaction of a water-soluble polyvalent metal salt with an alkali metal hydroxide (or alkali metal hydroxide salt) in an aqueous phase, is used as a dispersion stabilizer, not only a polymerization toner having a sharper particle size distribution is provided but also the amount of a dispersion stabilizer still remaining on the surfaces of toner particles after the polymerization may be reduced, as compared with that in a case where a conventional hardly water-soluble inorganic substance is used as a dispersion stabilizer; and the use of such a hardly water-soluble metal hydroxide colloid is extremely effective in achieving the above-mentioned objects.

As a result of further study of the present inventors, it has also been found that in a case where a polymerization toner is produced by using as a dispersion stabilizer the above-mentioned hardly water-soluble metal hydroxide colloid based on the reaction in an aqueous phase, when a continuous-type dispersing machine utilizing a high shearing force is used as a means for dividing or granulating a polymerizable monomer composition mainly comprising a polymerizable monomer into droplets having a particle size suitable for toner, the particle size distribution of the resultant toner may further be sharpened; and the use of such a continuous-type dispersing machine is particularly preferred.

According to the present invention, there is provided a process for producing a toner for developing an electrostatic image, comprising:

adding to an aqueous dispersion medium a polymerizable monomer composition comprising at least a polymerizable monomer and a colorant uniformly dissolved or dispersed in the polymerizable monomer, said aqueous dispersion medium containing as a dispersion stabilizer a hardly water-soluble metal hydroxide colloid formed by a reaction of a water-soluble polyvalent metal salt with an alkali metal hydroxide in an aqueous phase; and subjecting the polymerizable monomer composition to suspension polymerization, thereby to produce particles having a volume-average particle size in the range of from 2 to 20 μm and a particle size distribution (a ratio of volume-average particle size/number-average particle size) of not more than 1.6.

The present invention also provides a process for producing a toner for developing an electrostatic image as described above, wherein the hardly water-soluble metal hydroxide colloid formed by the reaction of the water-soluble polyvalent metal salt with the alkali metal hydroxide in the aqueous phase has a particle size distribution by number of particles of not more than 0.5 μm in terms of $D_{50}$ and a particle size distribution by number of particles of not more than 1 m in terms of $D_{90}$.

The present invention further provides a process for producing a toner for developing an electrostatic image as described above, wherein the ratio ($A=b/a$) of the chemical equivalent (b) of the alkali metal hydroxide to the chemical equivalent (a) of the water-soluble polyvalent metal salt satisfies a relationship of $0.4 \leqq A \leqq 1.0$, at the time of the formation of the hardly water-soluble metal hydroxide colloid based on the reaction of the water-soluble polyvalent metal salt with the alkali metal hydroxide in the aqueous phase.

The present invention further provides a process for producing a toner for developing an electrostatic image as described above, wherein the water-soluble polyvalent metal salt is selected from the group consisting of a magnesium salt, a calcium salt and an aluminum salt.

The present invention further provides a process for producing a toner for developing an electrostatic image as described above, wherein a continuous-type dispersing machine utilizing a high shearing force is used as means for dispersing or dissolving the monomer composition in the aqueous dispersion medium containing the hardly water-soluble metal hydroxide colloid as a dispersion stabilizer, and for dividing or granulating the monomer composition in the aqueous dispersion medium into droplets having a particle size suitable for toner.

In the above-mentioned process for producing a toner according to the present invention, a water-soluble polyvalent metal salt is reacted with an alkali metal hydroxide in an aqueous phase (water phase) to produce a hardly water-soluble metal hydroxide(or metal salt) colloid. Then, without drying or solidifying the thus prepared colloidal particles, a uniform or homogeneous mixture for toner components (monomer composition) is added to the aqueous phase containing such colloidal particles and the resultant mixture is subjected to suspension polymerization.

In the present invention, the particle size distribution of the hardly water-soluble metal hydroxide colloid formed in the aqueous phase is extremely sharp as compared with that obtained in a case where a commercially available hardly water-soluble metal salt is dispersed in an aqueous phase. (For example, in the present invention, $D_{50}$ of the number-basis particle size distribution of the colloid particles may be not more than 0.5 μm and $D_{90}$ of the number-basis particle size distribution may be not more than 1 μm). Accordingly, when the uniform mixture in which predetermined components for toner inclusive of a polymerizable monomer and a colorant (and optionally, other at least one component such as charge controlling agent, as desired) are dissolved and/or dispersed, is added to the aqueous phase and is granulated into small droplets, e.g., by use of stirring with a high shearing force in the next step, the resultant droplets may be sufficiently dispersed and stabilized even in a case where a relatively small amount of the hardly water-soluble metal hydroxide colloid is used. In addition, the above-mentioned hardly water-soluble metal hydroxide colloid having a sharp particle size distribution in a relatively small amount may be easily removed from the reaction product by washing of the reaction product with an acid or washing thereof with water to be conducted after the polymerization.

In the present invention, when the water-soluble polyvalent metal salt is reacted with the alkali metal hydroxide in the aqueous phase so as to form the hardly water-soluble metal hydroxide colloid, the chemical equivalent ratio ($A=b/a$) of the alkali metal hydroxide (chemical equivalent: b) to the water-soluble polyvalent metal salt (chemical equivalent: a) may preferably be $0.4 \leqq A \leqq 1.0$. In such a preferred embodiment of the present invention, the washing with an acid may easily be effected, because there is no excessive alkali metal hydroxide in the washing of the metal hydroxide colloid on the toner particles after the polymerization, with an acid. Further, in such an embodiment, the effect on the dispersion stability produced by the colloid formed in the aqueous medium may be enhanced on the basis of a buffer effect of a residual or excess portion of the water-soluble polyvalent metal salt. In addition, in this embodiment, the coalescence and agglomeration (or aggregation) of the particles formed by the polymerization may effectively be prevented in the subsequent polymerization step.

In the present invention, a further sharp particle size distribution of a toner may be provided in a case where a continuous-type dispersing machine utilizing cavitation or spiral vortex (or turbulent flow) is used as means for dissolving or dispersing the above-mentioned components for toner in the aqueous medium containing the hardly water-soluble metal hydroxide as a dispersion stabilizer, and for dividing or granulating the droplets comprising predetermined components for toner into those having a particle size suitable for a toner (e.g., on the basis of a high shearing force).

As described above, in the present invention, the above-mentioned metal hydroxide colloid may easily be removed by washing with an acid and/or water to be ordinarily conducted after the polymerization, and therefore the resultant toner particles may have excellent electrical or triboelectric characteristics.

Further, the toner to be produced by the process according to the present invention has a small average particle size of from 2 to 20 μm and has an extremely narrow particle size distribution, i.e., a ratio (volume-average particle size/number-average particle size) of not more than 1.6, and therefore the toner produced by the present invention may have excellent image quality characteristics with respect to resolution, fog, etc.

Further objects and advantages of the present invention will be apparent from the description of the preferred embodiments with the accompanying drawing.

The present invention will become more fully understood from the detailed description given hereinbelow and the accompanying drawing which is given by way of illustration only, and thus is not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
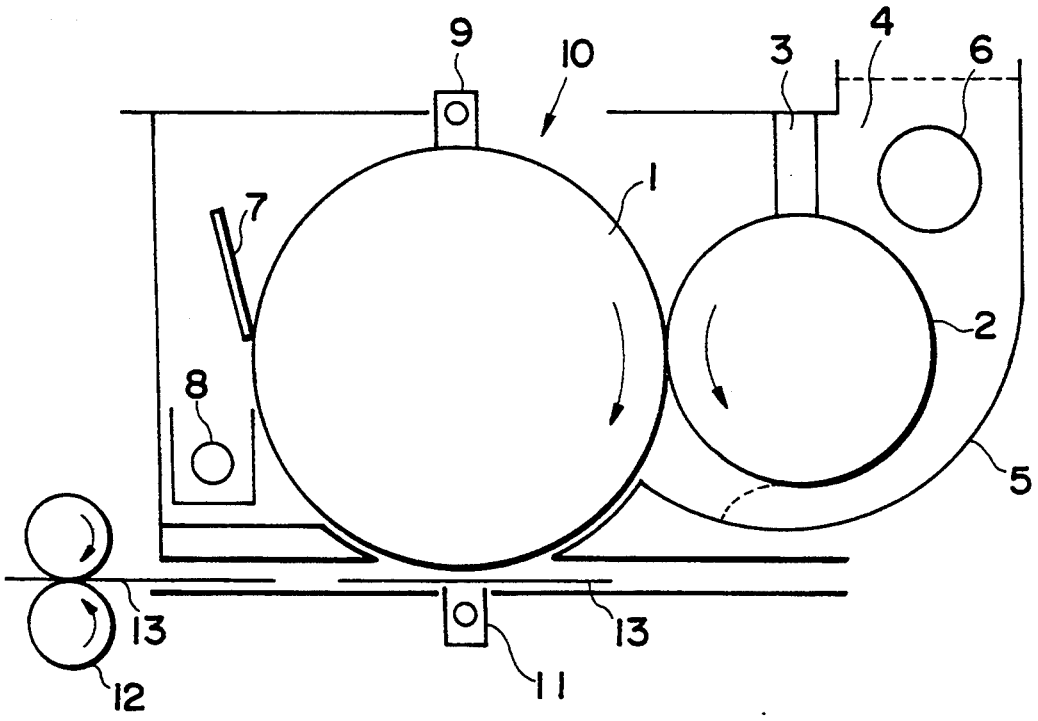
FIG. 1 is a schematic sectional view showing an embodiment of electrophotographic apparatus in which a non-magnetic one-component developer may be used.

DETAILED DESCRIPTION OF PREFERRED EMBODIMENTS (Water-soluble polyvalent metal salt)

Specific examples of the water-soluble polyvalent metal salt usable in the present invention may include: chlorides, sulfates, nitrates, acetates, etc., of a polyvalent metal such as magnesium, calcium, aluminum, iron, copper, manganese, nickel and tin. Among these water-soluble polyvalent metal salts, a salt comprising magnesium, calcium and/or aluminum may particularly preferably be used in view of dispersion stability.

(Alkali metal hydroxide)

Specific examples of the alkali metal hydroxide usable in the present invention may include: hydroxides of an alkali metal, such as lithium hydroxide, sodium hydroxide, and potassium hydroxide.

The concentrations of the water-soluble polyvalent metal salt and the alkali metal hydroxide in the aqueous dispersion medium (aqueous phase) may be determined depending on a desired particle size (toner particle size), but the above concentrations may preferably be those providing a concentration of the hardly water-soluble metal hydroxide to be formed on the basis of the water-soluble polyvalent metal salt and the alkali metal hydroxide, in a range of from 0.1 to 20 parts by weight (more preferably, in a range of from 1 to 10 parts by weight) with respect to 100 parts by weight of the polymerizable monomer. Further, the ratio ($A=b/a$) of the amount of the alkali metal hydroxide (chemical equivalent=b) to the amount of the water-soluble polyvalent metal salt (chemical equivalent=a) may preferably be a chemical equivalent ratio (A) satisfying a relationship of $0.4 \leqq A \leqq 1.0$ (more preferably, $0.6 \leqq A \leqq 0.8$). (Hardly water-soluble metal hydroxide colloid)

In the present invention, the hardly water-soluble metal hydroxide colloid to be formed by the reaction of the water-soluble polyvalent metal salt with the alkali metal hydroxide in the aqueous phase may preferably have a sharp particle size distribution. More specifically, the metal hydroxide colloid may preferably have a $D_{50}$ of number-basis particle size distribution of not more than 0.5 μm (more preferably, not more than 0.4 μm). In addition, the metal hydroxide colloid may preferably have a $D_{90}$ of number-basis particle size distribution of not more than 1 μm (more preferably, not more than 0.8 μm). If the above $D_{50}$ exceeds 0.5 μm or the above $D_{90}$ exceeds 1 μm, the particle size distribution of the hardly water-soluble metal hydroxide colloid becomes relatively broad, and therefore the particle size distribution of the toner provided by the polymerization using such hardly water-soluble metal hydroxide colloid is liable to be relatively broad. In addition, in such a case, easiness in the removal of the hardly water-soluble metal hydroxide colloid by washing with acid or water to be conducted after the polymerization can be decreased.

The $D_{50}$ used herein refers to a particle size corresponding to 50% cumulative value in the number-basis particle size distribution measured by means of a small particle size measuring apparatus (for example, Microtrack Particle Size Distribution Measuring Apparatus), and the above $D_{90}$ refers to a particle size corresponding to 90% cumulative value in the number-basis particle size distribution as described above. (Dissolution and/or dispersion of toner constituents)

In the present invention, in order to disperse a mixture liquid of constituents comprising a polymerizable monomer and a colorant (and another additive such as charge controlling agent, as desired) dissolved or dispersed therein, in an aqueous dispersion medium containing a dispersion stabilizer into droplets, high-shearing force mixing may generally be used. Such high-shearing force mixing may be conducted by using an appropriate high-shearing force mixing means such as homomixer and homogenizer.

In the present invention, a means for providing a shearing force by utilizing cavitation, spiral vortex, and/or turbulent flow may preferably be used as means for adding toner constituents mainly comprising a polymerizable monomer to an aqueous dispersion medium containing the hardly water-soluble metal hydroxide colloid as a dispersion stabilizer, and for dividing or granulating the toner constituents into droplets having a particle size suitable for a toner, to prepare a toner having a further sharp particle size distribution.

The "cavitation" used herein refers to a phenomenon such that when an object (such as rotor and turbine blade) is moved at a high speed (e.g., rotated at a high speed), bubbles are produced on the basis of a pressure decrease due to the Bernoulli's theorem, in the neighborhood of a surface of the object moving at a high speed (e.g., rear face of the object). When the cavitation occurs, a strong shearing force may be provided on the basis of ultrasonic wave to be produced in such a case.

As the continuous-type dispersing machine utilizing cavitation, for example, a continuous-type machine including a stator and a rotor may preferably be used specific examples of such a continuous-type dispersing machine may include those sold under the trade names of: Slasher (mfd. by Mitsui-Miike Seisakusho K.K.), TK-type Hi-line Mill (mfd. by Tokushu Kika Kogyo K.K.), Milder (mfd. by Ebara Seisakusho K.K.), TK-type Homomic-line Flow (mfd. by Tokushu Kika Kogyo K.K.), TK-type Pipeline Homomixer (mfd. by Tokushu Kika Kogyo K.K.), etc. In addition, another dispersing machine is usable in the present invention as long as it can provide cavitation in a similar manner.

On the other hand, as the dispersing machine utilizing spiral vortex or turbulent flow, it is preferred to use a dispersing machine using a system wherein a liquid to be dispersed is jetted or poured from a narrow or slender liquid passage (such as nozzle and slit) at a high speed so as to provide spiral vortex on the basis of the energy of the jetted liquid; or a dispersing machine using a system wherein turbulent flow is provided on the basis of the interaction between a liquid moving at a high speed and a stationary blade disposed in the vessel thereof or between the liquid and a special shape provided in the vessel thereof. Specific examples of such a dispersing machine using spiral vortex or turbulent flow (continuous type) may include: those using a rotary spiral vortex system which are sold under the trade names of Hydrosher (mfd. by Goulin Corporation), Static Mixer PSM (mfd. by Bettshold), TK-type Soiskarin (mfd. by Tokushu Kika Kogyo K.K.), etc.; those using a turbulent flow system (line-mixer type) which are sold under the trade names of Sulzer Mixer (mfd. by Sulzer Brothers Corp.), Hi-Mixer (mfd. by Toray K.K.), Noritake Static Mixer (mfd. by Noritake K.K.), etc.

Hereinbelow, respective toner constituents constituting a polymerizable monomer composition will specifically be described.

(Polymerizable monomer)

Specific examples of the polymerizable monomer usable in the present invention may include: aromatic vinyl monomers such as styrene, s-methyl styrene, p-methyl styrene and p-chlorostyrene; unsaturated nitriles such as acrylonitrile; unsaturated acrylates and unsaturated methacrylates such as methyl (meth)acrylate, ethyl (meth)acrylate, butyl (meth)acrylate, ethylhexyl (meth)acrylate, lauryl (meth)acrylate and stearyl (meth-)acrylate; conjugated diolefins such as butadiene and isoprene; etc. These monomers may be used alone or in a mixture of two or more species, as desired.

(Additive)

In the present invention, there can be used, as desired, at least one species selected from various additives such as oil-soluble initiators, molecular weight modifiers, crosslinking monomers and releasing agents in combination with the above-mentioned polymerizable monomer.

(Oil-soluble initiator)

As the oil-soluble initiator, those soluble in a monomer to be used for the polymerization may be employed without particular limitations. Specific examples thereof may include: peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, di-iso-propyl peroxydicarbonate and di-t-butyl diperoxy isophthalate; and azo-compounds such as 2,2'-azobis(2,4-dimethyl valeronitrile), 2,2'-azobisisobutyronitrile and 1,1'-azobis(1-cyclohexane carbonitrile).

The above-mentioned oil-soluble initiator may preferably be used in an amount of from 0.1 to 20 parts by weight (more preferably, from 1 to 10 parts by weight) with respect to 100 parts by weight of the polymerizable monomer.

(Molecular weight modifier)

Specific examples of the molecular weight modifier to be used in the present invention as desired may include: mercaptans such as t-dodecyl mercaptan, n-dodecyl mercaptan and n-octyl mercaptan; halogenated hydrocarbons such as carbon tetrachloride and carbon tetrabromide; etc. The molecular weight modifier may be added into the reaction system before the polymerization and/or during the polymerization.

The above molecular weight modifier may preferably be used in an amount of from 0.01 to 10 parts by weight (more preferably, of from 0.1 to 5 parts by weight) with respect to 100 parts by weight of the polymerizable monomer.

(Crosslinking monomer)

Specific examples of the crosslinking monomer to be used in the present invention as desired may include: polyfunctional monomers such as divinylbenzene, ethylene glycol di(meth)acrylate, glycidyl (meth)acrylate and trimethylolpropane tri(meth)acrylate. The crosslinking monomer may be added to the reaction system before the polymerization and/or during the polymerization.

The crosslinking monomer as described above may preferably be used in an amount of from 0.01 to 10 parts by weight (more preferably, from 0.1 to 5 parts by weight) with respect to 100 parts by weight of the polymerizable monomer.

(Releasing agent)

Specific examples of the releasing agent to be used in the present invention as desired may include: low-molecular weight polyolefins such as low-molecular weight polyethylene, low-molecular weight polypropylene and low-molecular weight polybutylene.

The above releasing agent may be preferably used in an amount of from 0.1 to 20 parts by weight (more preferably, from 1 to 10 parts by weight) with respect to 100 parts by weight of the polymerizable monomer.

(Colorant)

Specific examples of the colorant usable in the present invention may include: dyes and pigments such as carbon black, Nigrosine base, Aniline Blue, Chalcoil Blue, Chrome Yellow, Ultramarine Blue, Orient Oil Red, Phthalocyanine Blue and Malachite Green oxalate; and magnetic particles such as iron, cobalt, nickel, di-iron trioxide, tri-iron tetroxide, manganese iron oxide, zinc iron oxide and nickel iron oxide.

In a case where the colorant as described above is used, the dye and/or pigment may preferably be used in an amount of from 0.1 to 20 parts by weight (more preferably, from 1 to 10 parts by weight) with respect to 100 parts by weight of the polymerizable monomer. On the other hand, the above magnetic particles may preferably be used in an amount of from 1 to 100 parts by weight (more preferably, from 5 to 50 parts by weight) with respect to 100 parts by weight of the polymerizable monomer.

(Charge controlling agent)

In the present invention, it is preferred to use, as a component constituting a dispersoid or dispersed phase (polymerizable monomer composition), a charge controlling agent in combination with the above-mentioned colorant and polymerizable monomer in order to improve the charging properties or chargeability of the toner to be produced by the polymerization. As the charge controlling agent, at least one species selected from various charge controlling agents having positive chargeability or negative chargeability may be used. Specific Examples of the charge controlling agent may include Spiron Black TRH (mfd. by Hodogaya Kagaku K.K.), T-77 (mfd. by Hodogaya Kagaku K.K.) and Bontron S-34 (mfd. by Orient Kagaku Kogyo K.K.).

The above charge controlling agent may preferably be used in an amount of from 0.01 to 10 parts by weight (more preferably, from 0.1 to 5 parts by weight) with respect to 100 parts by weight of the polymerizable monomer.

(Lubricant/Dispersing auxiliary)

In the present invention, in order to improve the uniformity of the colorant dissolved or dispersed in the resultant toner particles, it is possible to incorporate in the above-mentioned dispersed phase, a lubricant such as oleic acid and stearic acid, and/or a dispersing auxiliary such as silane-type or titanium-type coupling agent. The lubricant or dispersing auxiliary may preferably be used in a proportion of about 1/1000 to 1/50 based on the weight of the colorant.

(Aqueous dispersion medium)

As the aqueous dispersion medium constituting the aqueous phase to be used in the present invention, water or an aqueous liquid containing water as a main component may be used. In the present invention, there is no particular limitation as to the ratio or proportion of the dispersed phase comprising at least the above-mentioned colorant and polymerizable monomer to the aqueous dispersion medium. In view of easiness in the formation of droplets in the aqueous dispersion medium and in view of the dispersing stability of the droplets or particles during the polymerization reaction, the concentration of the dispersed phase in the system, i.e., (the weight of the dispersed phase)/(the sum of the weight of the dispersed phase and the weight of the dispersion medium) may preferably be in the range of about 5 to 50% by weight (more preferably, about 20 to 30 by weight).

(Toner particles)

After the completion of the polymerization of the dispersed phase (monomer composition) as described above, the hardly water-soluble metal hydroxide remaining on the surfaces of the toner particles may be removed, e.g., by using ordinary washing with an acid and/or water, and then the resultant product is subjected to dehydration and drying thereby to provide toner particles. According to the present invention, there may be obtained toner particles having a sharp particle size distribution such that they have a volume-average particle size in the range of from 2 to 20 μm and a particle size distribution (i.e., ratio of volume-average particle size/number-average particle size) is not more than 1.6. (Examples)

Hereinbelow, the present invention will be described in more detail with reference to specific Examples. It should be, however, understood that the present invention is by no means restricted by such specific Examples. In the following Examples and Comparative Examples, "part(s)" and "%" mean those by weight unless otherwise noted specifically.

EXAMPLE 1

| | |
|---|---|
| Styrene | 70 parts |
| n-Butyl methacrylate | 30 parts |
| Carbon Black (Printex 150 T, mfd. by Degussa Co.) | 5 parts |
| Charge controlling agent (Spiron Black TRH, mfd. by Hodogaya Kagaku K.K.) | 1 part |
| Divinylbenzene | 0.3 part |
| 2,2'-Azobisisobutyronitrile | 2 parts |

The above ingredients were stirred and mixed at 6000 rpm by means of a high-shearing force mixer (trade name: TK homomixer mfd. by Tokushu Kika Kogyo K.K.) to prepare a uniformly dispersed polymerizable monomer composition.

Then, an aqueous solution containing 6.9 parts of sodium hydroxide (alkali metal hydroxide) dissolved in 50 parts of ion-exchange water (i.e., water which had been subjected to ion exchange) was gradually added to an aqueous solution containing 9.8 parts of magnesium chloride (water-soluble polyvalent metal salt) dissolved in 250 parts of ion-exchange water, under stirring to prepare a magnesium hydroxide colloid (hardly water-soluble metal hydroxide colloid) dispersion. At this time, the amount of addition of the sodium hydroxide (chemical equivalent ratio of the alkali metal hydroxide to the water-soluble polyvalent metal salt) (A) was 0.84.

The particle size distribution of the colloid thus obtained was measured by means of a Microtrack Particle Size Distribution Measuring Apparatus (mfd. by Nikkiso K.K.). The particle size $D_{50}$ (50% cumulative value in particle size distribution by number of particles) was 0.38 μm, and $D_{90}$ (90% cumulative value in particle size distribution by number of particles) was 0.82 μm.

In the above measurement of the particle size distribution by the Microtrack Particle Size Distribution Measuring Apparatus, the following parameters were used.

| | |
|---|---|
| Measuring range: | 0.12–704 μm |
| Measuring time: | 30 seconds |
| Medium: | ion-exchange water |

Then, to the above-mentioned magnesium hydroxide colloid dispersion, the polymerizable monomer composition prepared above was charged and stirred with a high-shearing force at 8000 rpm by means of the TK-homomixer to form droplets of the polymerizable monomer composition (particles of monomer composition). The resultant aqueous dispersion of the polymerizable monomer composition was charged in a reactor equipped with a stirring blade, and subjected to polymerization at 65 ° C. for 8 hours under stirring thereby to obtain an aqueous dispersion of polymerization product (toner particles).

The particle size of the resultant toner particles after the completion of the polymerization was measured by means of a Coulter counter (mfd. by Nikkaki K.K.). The volume-average particle size (dv) was 5.8 μm and the particle size distribution (dv/dp), i.e., the ratio of the volume-average particle size (dv) to the number-average particle size (dp), was 1.32.

In the above measurement by the Coulter counter, the following parameters were used.

| | |
|---|---|
| Aperture size: | 100 μm |
| Medium: | Isoton II |
| Concentration: | 15% |
| Number of particles measured: | 50,000 |

Then, the aqueous dispersion of the above-mentioned polymerization product was subjected to washing with an acid (25° C., 10 minutes) in such a manner that the Ph of the system was controlled to be not more than 4 by use of sulfuric acid, and subjected to filtration to separate the solid content from water. To the solid content thus separated, 500 parts of ion-exchange water was newly added to again provide a slurry so as to wash the solid content with water. Then, such dehydration and water-washing was repeated several times, and the solid content was separated from water by filtration. Thereafter, the solid content was dried overnight in a drier (50° C.) to obtain toner particles.

To 100 parts of the toner particles thus obtained, 0.3 part of colloidal silica which had been subjected to treatment for imparting hydrophobicity thereto (trade name: R-972, mfd. by Nihon Aerosil K.K.) was added and mixed therewith by means of a Henschel mixer to prepare a developer (toner).

The volume resistivity of the developer was measured at 30° C. and at a frequency of 1 kHz by means of a dielectric loss meter (trade name: TRS-10, mfd. by Ando Denki K.K.), and the measured volume resistivity thereof was $1.0\times10^{11}\Omega\cdot$cm.

The developer thus obtained was subjected to image formation by means of a commercially available printer of a non-magnetic one-component developing type as shown in FIG. 1 under normal temperature-normal humidity conditions (temperature of 23° C. and humidity of 50%), for the purpose of evaluating the resultant image quality. As a result, the thus formed image had a high image density and was excellent in resolution without fog or nonuniformity.

Further, image quality evaluation was conducted in the same manner as described above under high temperature-high humidity conditions (temperature of 35° C. and humidity of 85%). The thus obtained image had good image qualities similar to those obtained under the above-mentioned normal temperature-normal humidity conditions.

In the above FIG. 1, the reference numerals have the following meanings.

1: photosensitive drum; 2: developing roller; 3: developing blade (made of rubber); 4: developer; 5: developer container; 6: stirring rod; 7: cleaning blade; 8: recycling screw; 9: charger wire; 10: optical signal or optical image; 11: transfer charger wire; 12: image fixing roller; 13: developer supporting material or transfer material (such as paper).

EXAMPLE 2

Toner particles were prepared by conducting polymerization of a polymerizable monomer composition, acid-washing and water-washing in the same manner as in Example 1 except that the amount of magnesium chloride was changed to 4.9 parts and the amount of sodium hydroxide was changed to 3.4 parts.

In this case, the amount of addition of sodium hydroxide (chemical equivalent ratio) (A) was 0.84 and the particle size of the colloid thus formed was 0.31 μm in terms of $D_{50}$ and 0.72 μm in terms of $D_{90}$. Further, the volume-average particle size of the toner particles was 8.3 μm and the particle size distribution (dv/dp) was 1.22.

To the above-mentioned toner particles, colloidal silica which had been subjected to hydrophobicity-imparting treatment was mixed in the same manner as in Example 1 to prepare a developer (toner). When the volume resistivity thereof was evaluated in the same manner as in Example 1, it was found to be $1.07\times10^{11}\Omega\cdot$cm.

The developer thus obtained was subjected to image formation to evaluate image quality in the same manner as in Example 1. As a result, a sharp image having a high image density and being free of fog and nonuniformity was obtained both under the normal temperature-normal humidity conditions and under the high temperature-high humidity conditions.

EXAMPLE 3

Toner particles were prepared by conducting polymerization of a polymerizable monomer composition, acid-washing and water-washing in the same manner as in Example 1 except that the amount of magnesium chloride was changed to 8.2 parts and the amount of sodium hydroxide was changed to 3.4 parts.

In this case, the amount of addition of sodium hydroxide (chemical equivalent ratio) (A) was 0.50 and the particle size of the colloid thus formed was 0.30 μm in terms of $D_{50}$ and 0.75 μm in terms of $D_{90}$. Further, the volume-average particle size of the toner particles was 8.5 μm and the particle size distribution (dv/dp) was 1.30.

To the above-mentioned toner particles, colloidal silica which had been subjected to hydrophobicity-imparting treatment was mixed in the same manner as in Example 1 to prepare a developer (toner). When the volume resistivity thereof was evaluated in the same manner as in Example 1, it was found to be $1.12\times10^{11}\Omega\cdot$cm cm.

The developer thus obtained was subjected to image formation to evaluate image quality in the same manner as in Example 1. As a result, a sharp image having a high image density and being free of fog and nonuniformity was obtained both under the normal temperature-normal humidity conditions and under the high temperature-high humidity conditions.

EXAMPLE 4

| | |
|---|---|
| Styrene | 85 parts |
| Butyl methacrylate | 15 parts |
| Carbon Black (BP-130, mfd. by Cabot Co.) | 5 parts |
| Charge controlling agent (Spiron Black TRH, mfd. by Hodogaya Kagaku K.K.) | 1 part |
| Low-molecular weight polypropylene (Biscol 550P, mfd. by Sanyo Kasei K.K) | 2 parts |
| Divinylbenzene | 0.3 part |
| Lauroyl peroxide | 3 parts |

The above ingredients were mixed and dispersed by means of a high-speed bead mill to obtain a uniform polymerizable monomer composition.

Then, an aqueous solution containing 3.4 parts of sodium hydroxide dissolved in 50 parts of ion-exchange water was gradually added to an aqueous solution containing 4.9 parts of magnesium chloride (water-soluble polyvalent metal salt) dissolved in 250 parts of ion-exchange water, under stirring to prepare a magnesium hydroxide colloid (hardly water-soluble metal hydroxide colloid) dispersion. In this case, the amount of addition of sodium hydroxide (chemical equivalent ratio) (A) was 0.84. The particle size distribution of the colloid thus formed was measured by means of the Microtrack Particle Size Distribution Measuring Apparatus. The particle size $D_{50}$ was 0.30 m and $D_{90}$ was 0.85 μm.

Then, to the above-mentioned magnesium hydroxide colloid dispersion, the polymerizable monomer composition prepared above was charged and stirred with a high shearing force at 8000 rpm by means of the TK-homomixer to form droplets of the polymerizable monomer composition. The resultant aqueous dispersion of the polymerizable monomer composition was charged in a reactor equipped with a stirring blade, and subjected to polymerization at 65° C. for 8 hours under stirring thereby to obtain an aqueous dispersion of polymerization product (toner particles).

The particle size of the resultant toner particles after the completion of the polymerization was measured by means of a Coulter counter. The volume-average particle size (dv) was 8.9 μm and the particle size distribution (dv/dp) was 1.32.

Then, the dispersion of the polymerization product prepared above was subjected to acid-washing, water-washing and dehydration in the same manner as in Example 1, thereby to obtain dry toner particles.

To the above-mentioned toner particles, colloidal silica which had been subjected to hydrophobicity-imparting treatment was mixed in the same manner as in Example 1 to prepare a developer (toner). When the volume resistivity thereof was evaluated in the same manner as in Example 1, it was found to be $3.47\times10^{11}\Omega\cdot$cm.

The developer thus obtained was subjected to image formation to evaluate image quality in the same manner as in Example 1. As a result, a sharp image having a high image density and being free of fog and nonuniformity was obtained both under the normal temperature-normal humidity conditions and under the high temperature-high humidity conditions.

EXAMPLE 5

Toner particles were prepared by conducting polymerization of a polymerizable monomer composition, acid-washing and water-washing in the same manner as in Example 4 except that 13.0 parts of aluminum sulfate was used as a water-soluble polyvalent metal salt and the amount of sodium hydroxide was changed to 7.7 parts.

In this case, the amount of addition of sodium hydroxide (chemical equivalent ratio) (A) was 0.84 and the particle size of the colloid thus formed was 0.45 μm in terms of $D_{50}$ and 0.93 μm in terms of $D_{90}$. Further, the volume-average particle size of the toner particles was 7.2 μm and the particle size distribution (dv/dp) was 1.28.

To the above-mentioned toner particles, colloidal silica which had been subjected to hydrophobicity-imparting treatment was mixed in the same manner as in Example 1 to prepare a developer (toner). When the volume resistivity of the developer was evaluated in the same manner as in Example 1 it was found to be $1.03\times10^{11}\Omega\cdot$cm.

The developer thus obtained was subjected to image formation to evaluate image quality in the same manner as in Example 1. As a result, a sharp image having a high image density and being free of fog and nonuniformity was obtained both under the normal temperature-normal humidity conditions and under the high temperature-high humidity conditions.

EXAMPLE 6

A polymerizable monomer composition was subjected to polymerization in the same manner as in Example 1 except that the monomer composition was dispersed by using a revolving spiral vortex-type dispersing machine (trade name: Hydrosher, mfd. by Goulin Corporation) instead of the TK-type Homomixer used in Example 1. More specifically, a mixture liquid comprising droplets of the polymerizable monomer composition (toner constituents) and an aqueous dispersion medium containing a dispersing stabilizer was caused to pass through the above Hydrosher three times at a pressure (gauge pressure) of 10 kg/cm$^2$ so as to disperse the monomer composition to form a dispersion. The thus prepared droplets of the monomer composition were subjected to suspension polymerization in the same manner as in Example 1, thereby to prepare toner particles.

The volume-average particle size (dv) of the resultant toner particles was 5 μm and the particle size distribution (dv/dp) was 1.20.

To the above-mentioned toner particles, colloidal silica which had been subjected to hydrophobicity-imparting treatment was mixed in the same manner as in Example 1 to prepare a developer (toner). When the volume resistivity of the developer was evaluated in the same manner as in Example 1, it was found to be $2.1\times10^{11}\Omega\cdot$cm.

When the developer thus obtained was subjected to image formation to evaluate image quality in the same manner as in Example 1, good results were obtained similarly as in Example 1. That is, a sharp image having a high image density and being free of fog and nonuniformity was obtained both under the normal temperature-normal humidity conditions and under the high temperature-high humidity conditions.

EXAMPLE 7

A polymerizable monomer composition was subjected to polymerization in the same manner as in Example 6 except that a continuous-type dispersing machine (trade name: Milder, mfd. by Ebara Seisakusho K.K.) was used instead of the Hydrosher used in Example 6. More specifically, a mixture liquid comprising droplets of a polymerizable monomer composition (toner constituents) and an aqueous dispersion medium containing a dispersing stabilizer was caused to pass through the above Milder three times at a feed rate of 120 L/hr at a revolving speed of 15,000 rpm so as to disperse the monomer composition to form a dispersion. The thus prepared droplets of the monomer composition were subjected to suspension polymerization in the same manner as in Example 1, thereby to prepare toner particles.

The volume-average particle size (dv) of the resultant toner particles was 6.1 μm and the particle size distribution (dv/dp) was 1.19.

To the above-mentioned toner particles, colloidal silica which had been subjected to hydrophobicity-imparting treatment was mixed in the same manner as in Example 1 to prepare a developer (toner). When the volume resistivity of the developer was evaluated in the same manner as in Example 1, it was found to be $2.6\times10^{11}\Omega\cdot$cm.

When the developer thus obtained was subjected to image formation to evaluate image quality in the same manner as in Example 1, good results were obtained similarly as in Example 1. That is, a sharp image having a high image density and being free of fog and nonuniformity was obtained both under the normal temperature-normal humidity conditions and under the high temperature-high humidity conditions.

EXAMPLE 8

A polymerizable monomer composition was subjected to polymerization in the same manner as in Example 7 except that the monomer composition was dispersed by using a line mixer-type turbulent flow system by means of Noritake Static Mixer (trade name, mfd. by Noritake K.K.) instead of the continuous-type dispersing machine Milder used in Example 7.

More specifically, a mixture liquid comprising droplets of the polymerizable monomer composition (toner constituents) and an aqueous dispersion medium containing a dispersing stabilizer was caused to pass through the above Noritake Static Mixer three times at an average inside (or inline) flow rate of 3 m/sec so as to disperse the monomer composition to form a dispersion. The thus prepared droplets of the monomer composition were subjected to suspension polymerization in the same manner as in Example 1, thereby to prepare toner particles. The volume-average particle size (dv) of the resultant toner particles was 5.8 μm and the particle size distribution (dv/dp) was 1.23.

To the above-mentioned toner particles, colloidal silica which had been subjected to hydrophobicity-imparting treatment was mixed in the same manner as in Example 1 to prepare a developer (toner). When the volume resistivity of the developer was evaluated in the same manner as in Example 1, it was found to be $2.0\times10^{11}\Omega\cdot$cm.

When the developer thus obtained was subjected to image formation to evaluate image quality in the same manner as in Example 1, good results were obtained similarly as in Example 1. That is, a sharp image having a high image density and being free of fog and nonuniformity was obtained both under the normal temperature-normal humidity conditions and under the high temperature-high humidity conditions.

Comparative Example 1

A monomer composition was subjected to polymerization in the same manner as in Example 1 except that 5 parts of commercially available magnesium hydroxide (first-class grade reagent, mfd. by Wako Junyaku K.K.) was added to 300 parts of ion-exchange water and dispersed by means of TK-homomixer (6000 rpm), and the resultant dispersion was used as a dispersion medium, instead of forming magnesium hydroxide (hardly water-soluble metal hydroxide) on the basis of a reaction of magnesium chloride with sodium hydroxide in an aqueous phase. As a result, dispersion stability during the reaction was not good, and no toner particles were obtained because polymerized particles were solidified.

The particle size of the magnesium hydroxide used in the above reaction was 1.5 μm in terms of $D_{50}$ and 5.3 μm in terms of $D_{90}$.

Comparative Example 2

A monomer composition was subjected to polymerization in the same manner as in Comparative Example 1 except that the amount of the commercially available magnesium hydroxide was changed to 25 parts, and then the resultant polymerization product was subjected to acid-washing, water-washing and dehydration in the same manner as in Example 1 to obtain toner particles.

The volume-average particle size of the thus obtained toner particles was 19.5 μm and the particle size distribution (dv/dp) was 2.9.

These toner particles were subjected to classification to adjust the volume-average particle size thereof to 11.3 μm and the particle size distribution (dv/dp) thereof to 1.39.

To the toner particles thus obtained, colloidal silica was mixed in the same manner as in Example 1 to obtain a developer (toner). When the volume resistivity of the resultant developer was evaluated in the same manner in Example 1, it was found to be $1.23\times10^{10}\Omega\cdot$cm.

Further, the developer was subjected to image formation to evaluate image quality in the same manner as in Example 1. As a result, only an unclear image having a low image density with fog and nonuniformity was obtained under either of the normal temperature-normal humidity conditions or the high temperature-high humidity conditions.

As described hereinabove, according to the present invention, there is provided a process for producing a toner for developing an electrostatic charge image, in which a monomer composition was subjected to suspension polymerization in an aqueous dispersion medium using as dispersion stabilizer a hardly water-soluble metal hydroxide colloid formed by reacting a water-soluble polyvalent metal salt with an alkali metal hydroxide (preferably, in a predetermined ratio therebetween) in an aqueous phase.

In the present invention, the particle size distribution of the above-mentioned hardly water-soluble metal hydroxide colloid may be made sharper (for example, the particle size distribution by number of particles is not more than 0.5 μm in terms of $D_{50}$ and not more than 1 μm in terms of $D_{90}$), and therefore suspension polymerization of the monomer composition may be conducted with excellent dispersion stability, even when the above-mentioned hardly water-soluble inorganic substance is used as a dispersion stabilizer in an extremely small amount. Accordingly, the present invention may provide a toner containing a colorant, which not only has a small particle size with an extremely narrow particle size distribution, but also is excellent in electrical characteristics and developing properties.

Many modifications of the present invention may be made without departing from the essential scope thereof. It should be understood that the present invention is not limited to the specific embodiments as described.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A process for producing a toner for developing an electrostatic image, comprising:

adding to an aqueous dispersion medium a polymerizable monomer composition comprising at least a polymerizable monomer and a colorant uniformly dissolved or dispersed in the polymerizable monomer, said aqueous dispersion medium containing as a dispersion stabilizer from 0.1 to 20 parts by weight, based on 100 parts by weight of the polymerizable monomer, of a hardly water-soluble metal hydroxide colloid formed by a reaction of a water-soluble polyvalent metal salt with an alkali metal hydroxide in an aqueous phase; and subjecting the polymerizable monomer composition to suspension polymerization, thereby to produce particles having a volume-average particle size in the range of from 2 to 20 μm and a particle size distribution (a ratio of volume-average particle size/number-average particle size) of not more than 1.6.

2. A process according to claim 1, wherein the polymerizable toner composition further contains a charge controlling agent.

3. A process according to claim 1, wherein the hardly water-soluble metal hydroxide colloid formed by the reaction of the water-soluble polyvalent metal salt with the alkali metal hydroxide in the aqueous phase has a particle size distribution by number of particles of not more than 0.5 μm in terms of $D_{50}$ and a particle size distribution by number of particles of not more than 1 μm in terms of $D_{90}$.

4. A process according to claim 1, wherein the ratio ($A=b/a$) of the chemical equivalent (b) of the alkali metal hydroxide to the chemical equivalent (a) of the water-soluble polyvalent metal salt satisfies a relationship of $0.4 \leqq A \leqq 1.0$, at the time of the formation of the hardly water-soluble metal hydroxide colloid based on the reaction of the water-soluble polyvalent metal salt with the alkali metal hydroxide in the aqueous phase.

5. A process according to claim 1, wherein the water-soluble polyvalent metal salt is selected from the group consisting of a magnesium salt, a calcium salt and an aluminum salt.

6. A process according to claim 1, wherein a continuous-type dispersing machine utilizing a high shearing force is used as means for dispersing or dissolving the monomer composition in the aqueous dispersion medium containing the hardly water-soluble metal hydroxide colloid as a dispersion stabilizer, and for dividing or granulating the monomer composition in the aqueous dispersion medium into droplets having a particle size suitable for toner.

7. A process according to claim 6, wherein the monomer composition is divided or granulated by utilizing a high shearing force based on cavitation.

8. A process according to claim 6, wherein the monomer composition is divided or granulated by utilizing a high shearing force based on spiral vortex or turbulent flow.

* * * * *